US005706392A

United States Patent [19]

Goldberg et al.

[11] Patent Number: 5,706,392

[45] Date of Patent: Jan. 6, 1998

[54] PERCEPTUAL SPEECH CODER AND METHOD

[75] Inventors: Randy G. Goldberg, Princeton; James L. Flanagan, Warren, both of N.J.

[73] Assignee: Rutgers, The State University of New Jersey, Piscataway, N.J.

[21] Appl. No.: 457,517

[22] Filed: Jun. 1, 1995

[51] Int. Cl.[6] ..... G10L 9/18

[52] U.S. Cl. ..... 395/2.19; 395/2.36

[58] Field of Search ..... 395/2.17, 2.19, 395/2.23, 2.24, 2.35, 2.36, 2.38; 455/72; 341/87, 76

[56] References Cited

U.S. PATENT DOCUMENTS

| | | | |
|---|---|---|---|
| 3,349,183 | 10/1967 | Campenella | 395/2.91 |
| 3,715,512 | 2/1973 | Kelly | 395/228 |
| 4,053,712 | 10/1977 | Reindl | 395/2.24 |
| 4,461,024 | 7/1984 | Rengger et al. | 395/2.42 |
| 4,856,068 | 8/1989 | Quatieri, Jr. et al. | 395/2.36 |
| 4,972,484 | 11/1990 | Theile et al. | 395/2.36 |
| 5,010,574 | 4/1991 | Wang | 395/2.31 |
| 5,054,073 | 10/1991 | Yazu | 395/2.14 |
| 5,157,760 | 10/1992 | Akagiri | 395/2.36 |
| 5,264,846 | 11/1993 | Oikawa | 395/2.36 |
| 5,305,420 | 4/1994 | Nakamura et al. | 395/2.8 |

*Primary Examiner*—Benedict V. Safourek

*Attorney, Agent, or Firm*—Weil, Gotshal & Manges LLP

[57] ABSTRACT

Simultaneous and temporal masking of digital speech data is applied to an MBE-based speech coding technique to achieve additional, substantial compression of coded speech over existing coding techniques, while enabling synthesis of coded speech with minimal perceptual degradation relative to the human auditory system. A real-time perceptual coder and decoder is disclosed in which speech may be sampled at 10 kHz, coded at an average rate of less than 2 bits/sample, and reproduced in a manner that is perceptually transparent to a human listener. The coder compresses speech segments that are inaudible due to simultaneous or temporal masking, while audible speech segments are not compressed.

5 Claims, 7 Drawing Sheets

PERCEPTUAL SPEECH CODER AND METHOD

BACKGROUND OF THE INVENTION

1. Field of the Invention

The present invention relates generally to speech coding, and in particular, to a method and apparatus for perceptual speech coding in which monaural masking properties of the human auditory system are applied to eliminate the coding of unnecessary signals.

2. Description of the Prior Art

Digital transmission of coded speech is becoming increasingly important in a wide variety of applications, such as multi-media conferencing systems, cockpit-to-tower speech transmissions for pilot/controller communications, and wireless telephone transmissions. By reducing the amount of data needed to code speech, one may optimally utilize the limited resources of transmission bandwidth. The importance of efficient digital storage of coded speech is also becoming increasingly important in contexts such as voice messaging, answering machines, digital speech recorders, and storage of large speech databases for low bit-rate speech coders. Economies in storage memory may be obtained through high quality low bit-rate coding.

Vocoders (derived from the words "VOice CODER") are devices used to code speech in digital form. Successful speech coding has been achieved with channel vocoders, formant vocoders, linear prediction (LPC) vocoders, homomorphic vocoders, and code excited linear prediction (CELP) vocoders. In all of these vocoders, speech is modeled as overlapping time segments, each of which is the response of a linear system excited by an excitation signal typically made up of a periodic impulse train (optionally modified to resemble a glottal pulse train), random noise, or a combination of the two. For each time segment of speech, excitation parameters and parameters of the linear system may be determined, and then used to synthesize speech when needed.

Another vocoder that has been used to achieve successful speech coding is the multi-band excitation (MBE) vocoder. MBE coding relies on the insight that most of the energy in voiced speech lies at harmonics of a fundamental frequency (i.e., the pitch frequency), and thus, an MBE vocoder has segments centered at harmonics of the pitch frequency. Also, MBE coding typically recognizes that many speech segments are not purely voiced (i.e., speech sounds, such as vowels, produced by chopping of a steady flow of air into quasi-periodic pulses by the vocal chords) or unvoiced (i.e., speech sounds, such as the fricatives "f" and "s," produced by noise-like turbulence created in the vocal tract due to constriction). Thus, while many vocoders typically have one Voiced/Unvoiced (V/UV) decision per frame, MBE vocoders typically implement a separate V/UV decision for each segment in each frame of speech.

MBE coding as well as other speech-coding techniques are known in the art. For a particular description of MBE coding and decoding, see D. W. Griffin, *The multi-band excitation vocoder,* PhD Dissertation: Massachusetts Institute of Technology (February 1987); D. W. Griffin & J. S. Lim, "Multiband excitation vocoder," *IEEE Transactions on Acoustics, Speech, and Signal Processing,* Vol. 36, No. 8 (August 1986), which are incorporated here by reference.

Also, a number of techniques are known in the art to compress coded speech. In particular, techniques are in use to code speech in which periods of silence are represented in compressed form. A period of silence may be determined by comparison to a reference level, which may vary with frequency. Such coding techniques are illustrated, for example, in U.S. Pat. No. 4,053,712 to Reindl, titled "Adaptive Digital Coder and Decoder," and U.S. Pat. No. 5,054,073 to Yazu, titled "Voice Analysis and Synthesis Dependent Upon a Silence Decision."

In addition, it is known that in a complex spectrum of sound, certain weak components in the presence of stronger ones are not detectable by a human's auditory system. This occurs due to a process known as monaural masking, in which the detectability of one sound is impaired by the presence of another sound. Simultaneous masking relates to frequency. If a tone is sounded in the presence of a strong tone nearby in frequency (particularly in the same critical band but this is not essential), its threshold of audibility is elevated. Temporal masking relates to time. If a loud sound is followed closely in time by a weaker one, the loud sound can elevate the threshold of audibility of the weaker one and render it inaudible. Temporal masking also arises, but to a lesser extent, when the weaker sound is presented prior to the strong sound. Masking effects are also observed when one or both sounds are bands Of noise; that is, distinct masking effects arise from tone-on-tone masking, tone-on-noise masking, noise-on-tone masking, and noise-on-noise masking.

Acoustic coding algorithms utilizing simultaneous masking are in use today to compress wide-band (7 kHz to 20 kHz bandwidth) acoustic signals. Two examples are Johnston's techniques and the Motion Picture Experts Group's (MPEG) standard for audio coding. The duration of the analysis window used in these wide-band coding techniques is 8 ms to 10 ms, yielding frequency resolution of about 100 Hz. Such methods are effective for wide-band audio above 5 kHz, in which critical bandwidths are greater than 200 Hz. But, for the 0 to 5 kHz frequency region that comprises speech, these methods are not at all effective, as 25 Hz frequency resolution is required to determine masked regions of a signal. Moreover, because speech coding may be performed more efficiently than coding of arbitrary acoustic signals (due to the additional knowledge that speech is produced by a human vocal tract), a speech-based coding method is preferable to a generic one.

SUMMARY OF THE INVENTION

Accordingly, it is an objective of the present invention to apply properties of human speech production and auditory systems to greatly reduce the required capacity for coding speech, with minimal perceptual degradation of the speech signal.

By applying simultaneous masking and temporal masking to coded speech, one may disregard certain unnecessary speech signals to achieve additional, substantial compression of coded speech over existing coding techniques, while enabling synthesis of coded speech with minimal perceptual degradation. With the method and apparatus of the present invention, speech may be sampled at 10 kHz, coded at an average rate of less than 2 bits/sample, and reproduced in a manner that is perceptually transparent to a listener.

The perceptual speech coder of the present invention operates by first filtering, sampling, and digitizing an analog speech input signal. Each frame of the digital speech signal is passed through an MBE coder for obtaining a fundamental frequency, complex magnitude information, and V/UV bits. This information is then passed through an auditory analysis module, which examines each frame from the MBE coder to determine whether certain segments of each frame are inaudible to the human auditory system due to simultaneous or temporal masking. If a segment is inaudible, it is zeroed-out when passed through the next block, an audibility thresholding module. In the preferred embodiment, this module eliminates segments that are less than 6 dB above a calculated audibility threshold and also eliminates entire frames of speech that are identified as being silent. The reduced information signal is then passed through a quantization module for assigning quantized values, which are passed to an information packing module for packing into an output data stream. The output data stream may be stored or transmitted. When the output data stream is recovered, it may be unpacked by a decoder and synthesized into speech that is perceptually transparent to a listener.

The present invention represents a significant advancement over known techniques of speech coding. Through use of the present invention, codes for both silent and non-silent periods of speech may be compressed. Applying principles of monaural masking, only speech that is audibly perceptible to a human is coded, enabling significant, additional compression over known techniques of speech coding.

BRIEF DESCRIPTION OF THE DRAWINGS

The foregoing advantages of the present invention are apparent from the following detailed description of the preferred embodiment of the invention with reference to the drawings, in which.

DETAILED DESCRIPTION OF A PREFERRED EMBODIMENT

1. Perceptual Speech Coding

Figure 1:
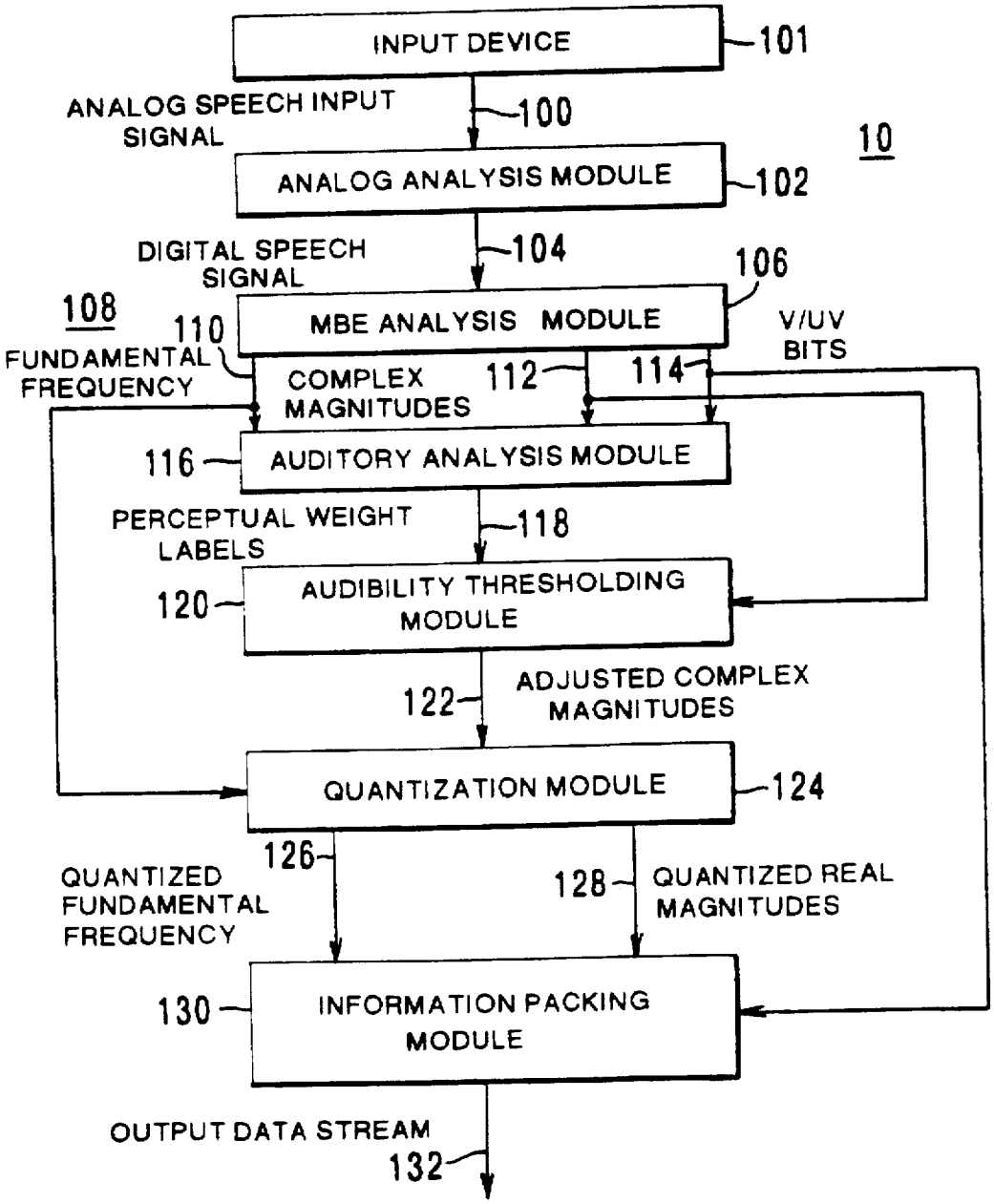
FIG. 1 shows a block diagram of the perceptual speech coder of the present invention.

FIG. 1 shows a block diagram of the perceptual speech coder 10 of the present invention, in which analog speech input signal 100 is provided to the coder, and output data stream 132 is produced for transmission or storage.

Analog speech input signal 100 enters the system via a microphone, tape storage, or other input device 101, and is processed in analog analysis module 102. Analog analysis module 102 filters analog input speech signal 100 with a lowpass anti-aliasing filter preferably having a cut-off frequency of 5 kHz so that speech can be sampled at a frequency of 10 kHz without aliasing. The signal is then sampled and windowed, preferably with a Hamming window, into 10 ms frames. Finally, the signal is quantized into digital speech signal 104 for further processing.

In MBE analysis module 106, each frame of digital speech signal 104 is transformed into the frequency domain to obtain a spectral representation of this digital, time-domain signal. In the preferred embodiment, MBE analysis module 106 performs multi-band excitation (MBE) analysis on digital speech signal 104 to produces MBE output 108 comprising a fundamental frequency 110, complex magnitudes 112, and V/UV bits 114. MBE analysis module 106 may be assembled in the manner suggested by Griffin et at. cited above, or other known ways.

MBE analysis module 106 first calculates fundamental frequency 110, which is the pitch of the current frame of digital speech signal 104. The fundamental frequency, or pitch frequency, may be defined as the reciprocal of an interval on a speech waveform (or a glottal waveform) that defines one dominant period. Pitch plays an important role in an acoustic speech signal, as the prosodic information of an utterance is primarily determined by this parameter. The ear is more sensitive to changes of fundamental frequency than to changes in other speech signal parameters by an order of magnitude. Thus, the quality of speech synthesized from a coded signal is influenced by an accurate measure of fundamental frequency 110. Literally hundreds of pitch extraction methods and algorithms are known in the art. For a detailed survey of several methods of pitch extraction, see W. Hess, *Pitch Determination of Speech Signals*, Springer-Verlag, New York, N.Y. (1983), which is incorporated here by reference.

After calculating fundamental frequency 110, MBE analysis module 106 computes complex magnitudes 112 and V/UV bits 114 for each segment of the current frame. Segments, or sub-bands, are centered at harmonics of fundamental frequency 110 with one segment per harmonic within the range of 0 to 5 kHz. The number of segments per frame typically varies from as few as 18 to as many as 60. From the estimated spectral envelope of the frame, the energy level in each segment is estimated as if excited by purely voiced or purely unvoiced excitation. Segments are then classified as voiced (V) or unvoiced (UV) excitation by computing the error in fitting the original speech signal to a periodic signal of fundamental frequency 110 in each segment. If the match is good, the error will be low, and the segment is considered voiced. If the match is poor, a high error level is detected, and the segment is considered unvoiced. With regard to complex magnitudes 112, voiced segments contain both phase and magnitude information, and are modeled to have energy only at the pertinent harmonic; unvoiced segments contain only magnitude information, and are modeled to have energy spread uniformly throughout the pertinent segment.

Although the preferred embodiment has been shown and described as using MBE analysis for transforming digital speech signal 104 into the frequency domain, other forms of coding are suitable for use with the present invention. For example, in embodiments that only perform temporal masking, most classical methods of speech coding work well. In addition, varying degrees of simultaneous masking may be obtained with other coding schemes. While MBE analysis provides a preferred solution in terms of allowing closely-spaced frequencies to be easily discerned and masked, those of skill in the art will find other forms of spectral analysis and speech coding useful with the temporal and/or simultaneous masking features of the present invention.

MBE output signal 110 is then passed through auditory analysis module 116. This module determines whether any segments are inaudible to the human auditory system due to simultaneous or temporal masking. To perform the masking process, auditory analysis module 116 associates with each segment of each frame of MBE output signal 110 (the segment outputs), a perceptual weight label 118, which indicates whether the speech in the segment is masked by speech in certain other segments.

Figure 2:
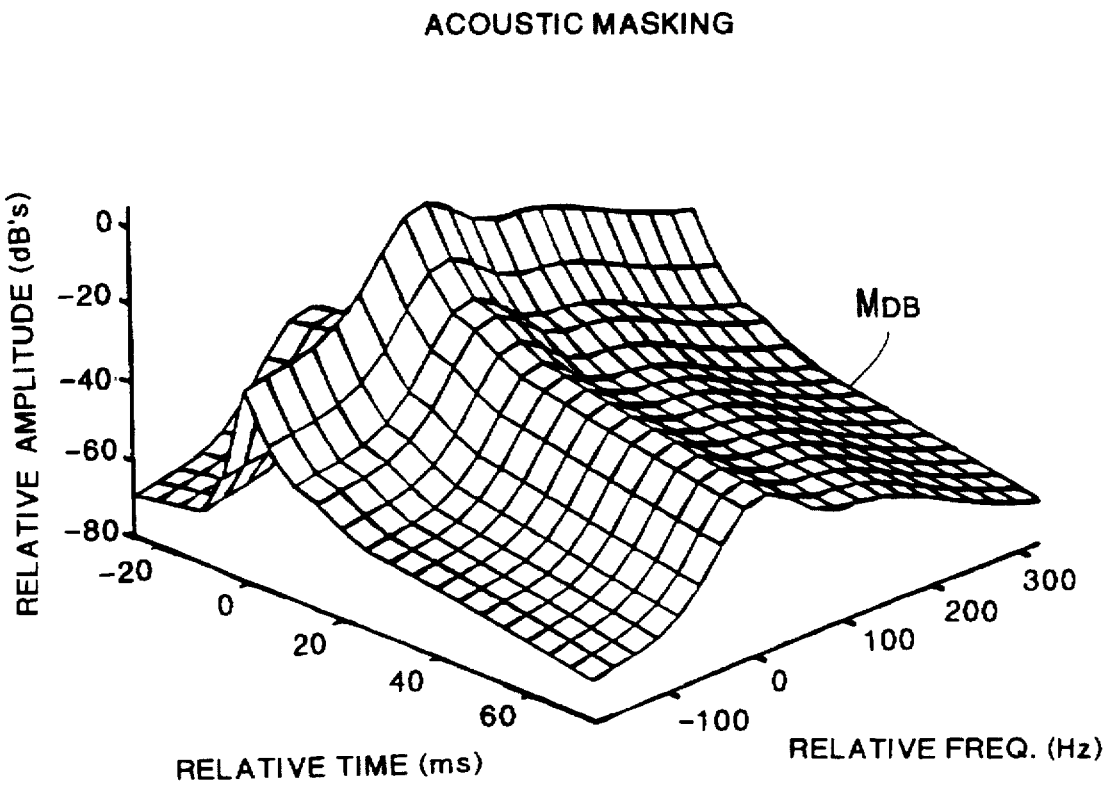
FIG. 2 shows representative psycho-acoustic masking data for simultaneous and temporal masking.

An illustrative but not exclusive way to calculate a perceptual weight label 118 is by comparing segment outputs and determining how much above the threshold of audibility, if at all, each segment is. Psycho-acoustic data such as that shown in FIG. 2 is used in this calculation. For each segment, the masking effects of the frequency components in the present frame, the previous 10 frames, and the next 3 frames (resulting in a 30 ms delay) are calculated. A segment's label—originally initialized to an arbitrary high value of 100 dB (relative to 0.0002 micro-bars)—is then set equal to the difference between the threshold of audibility for the unmasked signal and the largest masking effect. The preferred embodiment assumes that masking is not additive, so only the largest masking effect is used. This assumption provides a reasonable approximation of physical masking in which masking is somewhat additive.

To calculate the degree that one frequency segment masks another, four parameters are calculated: $A_{diff}$, the amplitude difference between the two frequency components; $t_{diff}$, the time difference between the two frequency components; $f_{diff}$, the frequency difference between the two frequency components; and $Th_{unmasked}$, the level above the threshold of audibility, without masking, of the masked frequency segment. Psycho-acoustic data (like that shown in FIG. 2) is then utilized to determine masking. In the preferred embodiment, one of four psycho-acoustic data sets is utilized depending on the classification of each of the masking and masked segments as tone-like (voiced) or noise-like (unvoiced); that is, separate data sets are preferably used for tone-on-tone masking, tone-on-noise masking, noise-on-tone masking, and noise-on-noise masking. The amount of masking ($M_{DB}$) is calculated by interpolating to the point in the psycho-acoustic data determined by the calculated parameters $A_{diff}$, $t_{diff}$, $f_{diff}$, and $Th_{unmasked}$. The value of $M_{DB}$ is subtracted from the value of $Th_{unmasked}$ to calculate a new threshold of audibility, $Th_{masked}$. The lowest value of $Th_{masked}$ for each segment—based on an analysis of the masking effects, if any, of each of the masking segments in the 14 frames reviewed—is stored as a masked segment's perceptual weight label 118.

Perceptual weight labels 118 and complex magnitudes 112 are then passed to audibility thresholding module 120, which zero-outs unnecessary segments. If the effective intensity of a segment is less than the threshold of audibility for the segment, it is not perceivable to the human auditory system and comprises an unnecessary signal. At a minimum, segments having a negative or zero perceptual weight label 118 fall into this class, and such segments may be zeroed-out by setting their respective complex magnitudes 112 to zero.

In addition, certain segments having positive perceptual weight labels 118 may also be zeroed-out (and preferably are to permit additional data compression). This result arises out of the fact that the threshold at which a signal can be heard in normal room conditions is a bit greater than the threshold of audibility, which is empirically defined under laboratory conditions for isolated frequencies. In particular, the cancellation of segments having perceptual weight labels 118 less than or equal to 6 dB was found to be perceptually insignificant in normal room conditions. When signals above this level were removed, perceptual degradation was observed in the synthesized quantized speech signal. When signals below this level were removed, maximum compression was not achieved.

Preferably, silence detection is also performed in audibility thresholding module 120. If the total energy in a frame is below a pre-determined level ($T_{sil}$, then the whole frame is labeled as silence, and parameters for this frame need be transmitted in substantially compressed form. The threshold level, $T_{sil}$, may be fixed if the noise conditions in the application are known, or it may be adaptively set with a simple energy analysis of the input signal.

Figure 3:
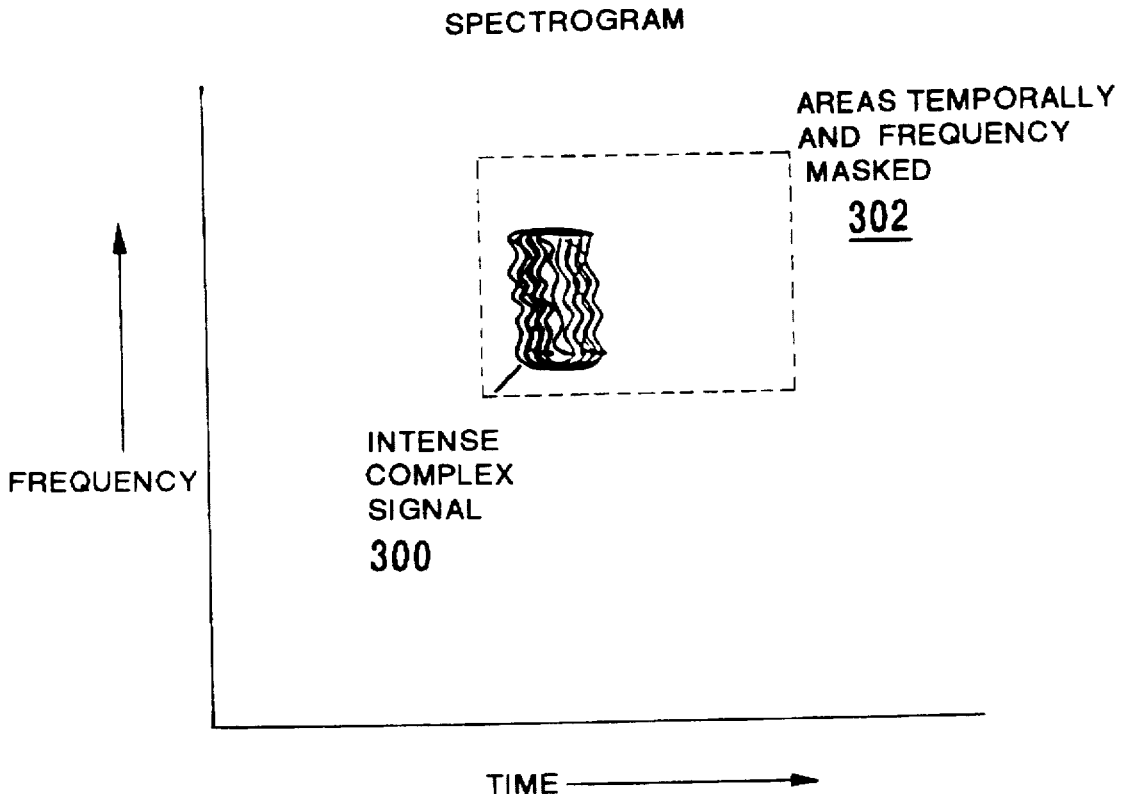
FIG. 3 illustrates masking effects on a speech signal of simultaneous and temporal masking.

The collective effect of auditory analysis module 116 and audibility thresholding module 120 is to isolate islands of perceptually-significant signals, as illustrated in FIG. 3. Digital capacity may then be assigned to efficiently and accurately code intense complex signal 300, while using a compressed coding scheme for areas temporally and frequency masked 302.

After MBE, auditory, and audibility analysis has been performed in modules 106, 116, and 120, the resulting parameters are quantized to reduce storage and transmittal demands. Both the fundamental frequency and the complex magnitudes are quantized. The V/UV bits are stored as one bit per decision and do not require further quantization. To perform quantization, fundamental frequency 110 and adjusted complex magnitudes 122 are passed to quantization module 124, which produces quantized fundamental frequency 126 and quantized real magnitudes 128.

In the preferred embodiment, a 10-bit linear quantization scheme is used to code fundamental frequency 110 of each frame. A minimum (80 Hz) and maximum (280 Hz) allowable fundamental frequency value is used for the quantization limits. The range between these limits is broken into linear quantization levels and the closest level is chosen as our initial quantization estimate. Since the number of segments per frame is directly calculated from the fundamental frequency of the frame, quantization module 124 must ensure that quantization of fundamental frequency 110 does not change the calculated number of segments per frame from the actual number. To do this, the module calculates the number of segments per frame (the 5 kHz bandwidth is divided by the fundamental frequency) for fundamental frequency 110 and quantized fundamental frequency 124. If these values are equal, fundamental frequency quantization is complete. If they are not equal, quantization module 124 adjusts quantized fundamental frequency 126 to the nearest quantized value that would make its number of segments per frame equal that of fundamental frequency 110. With ten bits, the quantization levels are small enough to ensure the existence of such a quantized fundamental frequency 126.

Adjusted complex magnitudes 122 at each harmonic of the fundamental frequency are also quantized in module 124. They are first converted into their polar coordinate representation, and the resulting real magnitude and phase components are quantized into separate 8-bit packets. The real magnitudes and phases are each quantized, preferably using adaptive differential pulse-code modulation (ADPCM) coding with a one word memory. This technique is well known in the art. For a particular description of ADPCM coding, see P. Cummiskey, et at., "Adaptive quantization in differential pcm coding of speech," *Bell System Technical Journal*, 52-7:1105-18 (September 1973) and N. S. Jayant, "Adaptive quantization with a one-word memory," Bell System Technical Journal, 52-7:1119-44 (September 1973), which are incorporated here by reference.

In the preferred embodiment, magnitudes are quantized in 256 steps, requiring 8 data bits. Phases are quantized in 224 steps, also requiring 8 data bits. The 224 eight bit words decimally represented as 0 to 223 (00000000 to 11011111 binary) are used to represent all possible output code words of the phase quantization scheme. The unused 32 words in the phase data are reserved to communicate information (not related to the phase of the complex magnitudes) about zeroed-segments (i.e., segments zeroed-out by audibility thresholding module 120) and silence frames.

Silence frames are often clustered together in time, that is, silence often is found in intervals greater than 10 ms. So as not to waste 8 bits for each silence frame detected, 16 words are reserved to represent silence frames. The sixteen 8-bit words decimally represented as 224 to 239 (11100000 to 11101111 binary) are reserved to represent 1 to 16 frames of silence. When one of these code words is encountered where an 8-bit phase is expected, the present frame (and up to the next 15 frames) are silence. All the silence codes begin with the 4-bit sequence 1110, which fact may be used to increase efficiencies in decoding.

Due to the formant structure of speech and the varying nature of speech in the time/frequency plane, magnitudes are often zeroed (due to masking) in clusters. So as not to waste a full eight bits for each zeroed-segment, 16 words are reserved to represent 1 to 16 consecutive zeroed-segments. The sixteen 8-bit words decimally represented as 240 to 255 (11110000 to 11111111 binary) are reserved to represent 1 to 16 zeroed-segments. When one of these code words is encountered where an 8-bit phase is expected, the present magnitude (and up to the next 15 magnitudes) need not be produced. All the zero magnitude codes begin with the 4-bit sequence 1111, which fact may be used to increase efficiencies in decoding.

Preferably, quantization module 124 quantizes in a circular order. This method capitalizes on the fact that a process that limits the short-time standard deviation of a signal to be quantized causes reduced quantization error in differential coding. Thus, magnitude coding starts with the lowest frequency sub-band of the first frame and continues with the next highest sub-band until the end of the frame is reached. The next frame begins with the highest frequency sub-band and decreases until the lowest frequency level is reached. All odd frames are coded from lowest frequency to highest frequency, and all even frames are coded in the reverse order. A silence frame is not included in the calculations of odd and even frames. Thus, if a first frame is non-silence, a second frame is silence, and a third frame is non-silence, the first frame is treated as an odd frame and the third frame is treated as an even frame. Phase quantization is in the same order to keep congruence in the decoding process.

After quantization has been performed in module 124, the resulting information is packed into output data stream 132 in packing module 130. For each frame, the information to pack includes quantized fundamental frequency 126, quantized real magnitudes 128, and V/UV bits 114. The perceptual coder is designed to code all this information in output data stream 132 comprising data at or below 20 kbits/s for all speech utterances. This real-time data rate translates to 2 bits/sample for a 10 kHz sampling rate of analog speech input signal 100.

Since the portion of quantized real magnitudes 128 comprising the quantized phase track contains the encoding packing information, the first eight bits in each frame will be the phase of the first harmonic. There are four possible situations.

First, if the frame being quantized is labeled a silence frame, then one of the 16 codes representing silence frames is used. Only one code-word is used for up to 16 frames of silence. A buffer holds the number of silence frames previously seen (up to 15), and as soon as a non-silence frame is detected, the 8-bit code representing the number of consecutive silence frames in the buffer is sent to output data stream 132. If the buffer is full and a seventeenth consecutive silence frame is detected, the code representing 16 frames of silence is sent to output data stream 132, the buffer is reset to zero, and the process continues.

Second, if the frame is non-silence but starts with a zeroed-segment (which corresponds to either the highest or lowest harmonic in a frame based on whether the frame is odd or even), one of the sixteen codes reserved for this situation is used. A buffer like the one used for silence-frame coding is used to determine how many consecutive zeroed-segments to code.

Third, if the frame is non-silence but starts with a magnitude corresponding to an unvoiced segment, then phase information is not used in re-synthesis and an arbitrary code (00000000 binary) representing zero phase is sent to output data stream 132.

Fourth, if the frame is non-silence and starts with a magnitude corresponding to a voiced segment, then the quantized phase value is sent to output data stream 132.

The next 10-bits sent to output data stream 132 after an 8-bit non-silence phase value is sent is the 10-bit codeword representing the quantized fundamental frequency of the frame, quantized fundamental frequency 126. Every frame of speech has one quantized fundamental frequency associated with it, and this data must be sent for all non-silence frames. Even when every segment in a frame is unvoiced, an arbitrary or default fundamental frequency was used in dividing the spectrum into frequency segments, and transmission of this frequency is pertinent so that the number of frequency bins in the frame may be calculated.

The rest of the information in the frame pertains to magnitudes, phases, and V/UV decisions. The next bit sent to output data stream 132 contains V/UV information for the first non-zeroed segment of speech. An 8-bit word containing the magnitude of the first segment follows the V/UV bit. The rest of the data in the frame is sent as follows: a V/UV bit, followed by either an 8-bit word representing quantized magnitude (Unvoiced segments) or two 8-bit words representing quantized phase and quantized magnitude (Voiced segments). Phase information is sent before magnitude information so that zeroed-segments are coded without sending a dummy magnitude. When a string of 1 to 15 zeroed-segments is sent to output data stream 132, a V/UV bit is sent delimiting a phase codeword to be sent next, and then the correct codeword is sent.

Figure 4:
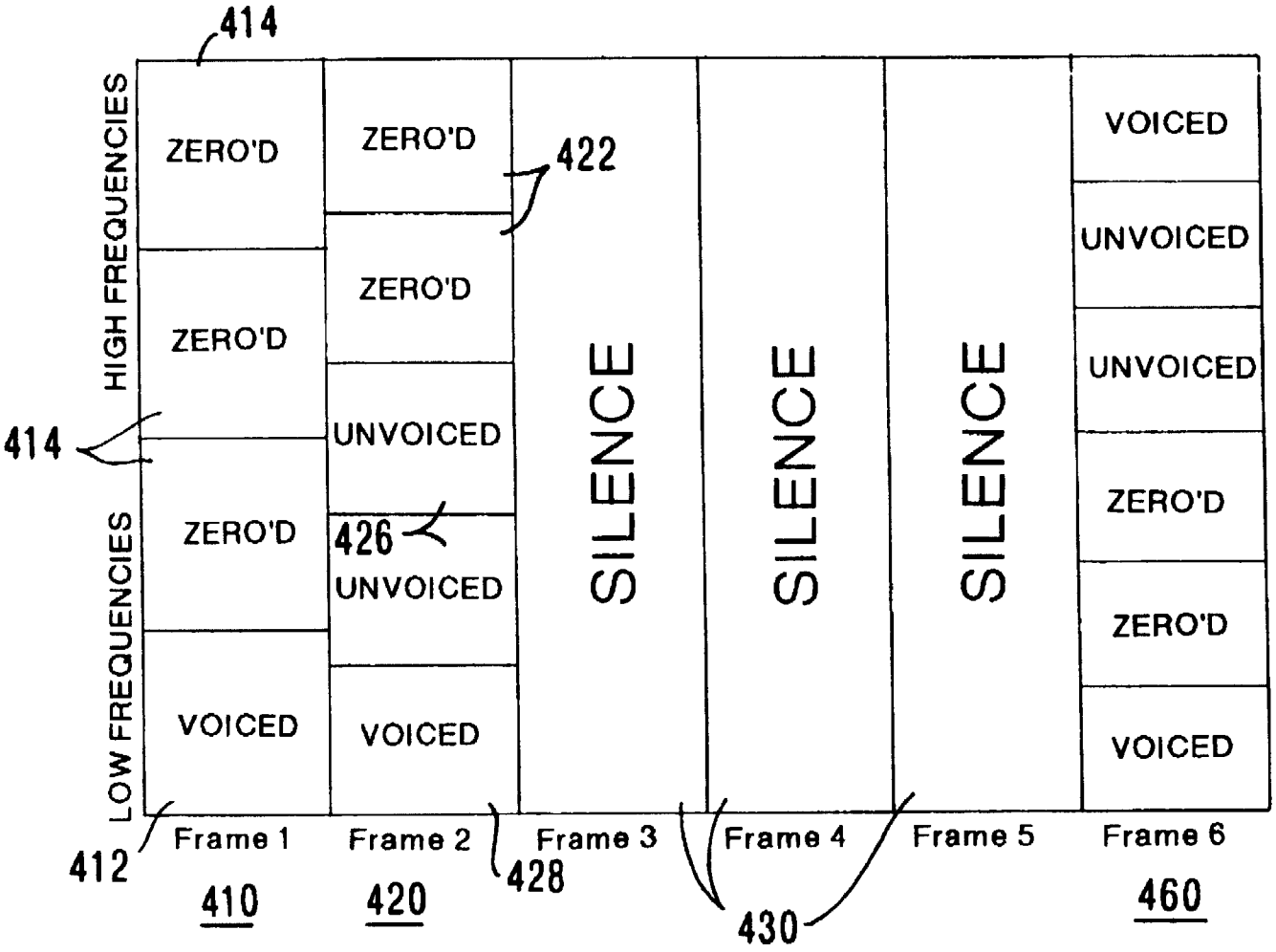
FIG. 4 shows sample frames of quantized coded speech data prior to packing.

To illustrate the information packing process that occurs in information packing module 130, FIG. 4 shows sample frames of quantized coded speech data prior to packing. Six frames of speech are shown in FIG. 4, each with differing numbers of harmonics. The number of harmonics shown in each frame is much less than would occur for actual speech data, the amount of information shown being limited for purposes of illustration.

Figure 5:
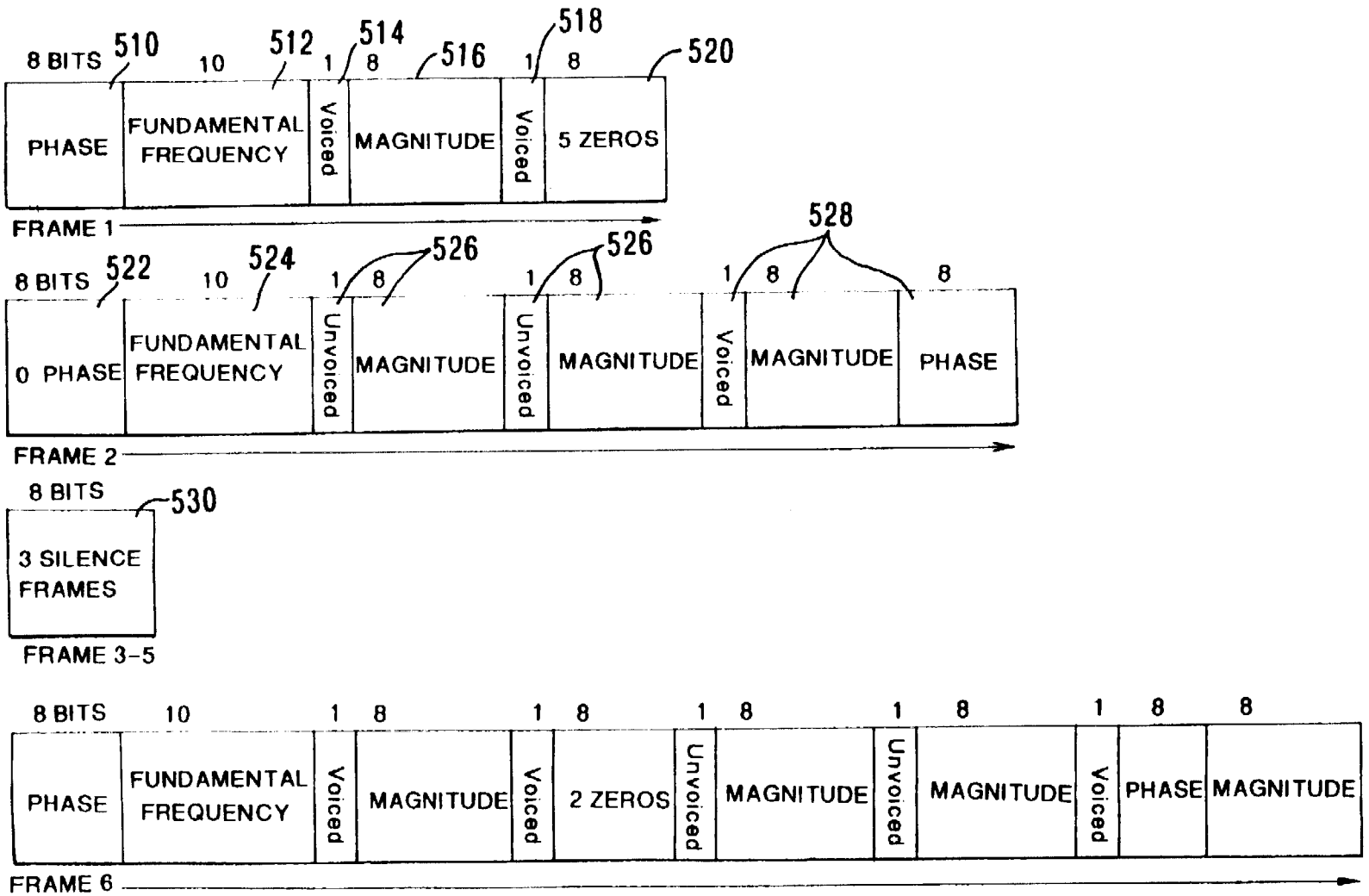
FIG. 5 shows bit patterns for the sample frames of FIG. 4 after packing.

FIG. 5 shows bit patterns for the sample frames of FIG. 4 after packing. The first eight bits 510 of packed data contains phase information for the lowest harmonic sub-band 412 of the first frame 410. The next ten bits 512 of packed data code the fundamental frequency of the first frame 410. The next bit 514 is a bit classifying the lowest harmonic sub-band 412 as voiced. The next eight bits 516 contain magnitude information for the lowest harmonic sub-band 412 of the first frame 410.

The remaining three harmonic sub-bands 414 in the first frame 410 as well as the two highest harmonic sub-bands 422 in the second frame 420 are zeroed-segments. Since ordering is circular, a code that represents five segments of zeroes must be transmitted. One bit 518 classifying the second frame 420 as voiced is transmitted, followed by an eight-bit code 520 indicating the five segments of zeroes. The fundamental frequency of the first segment is encoded with the number of segments in the first frame, indicating that three segments of zeros are within the boundary of first frame 410, and thus, two segments of zeros are part of second frame 420.

Figure 6:
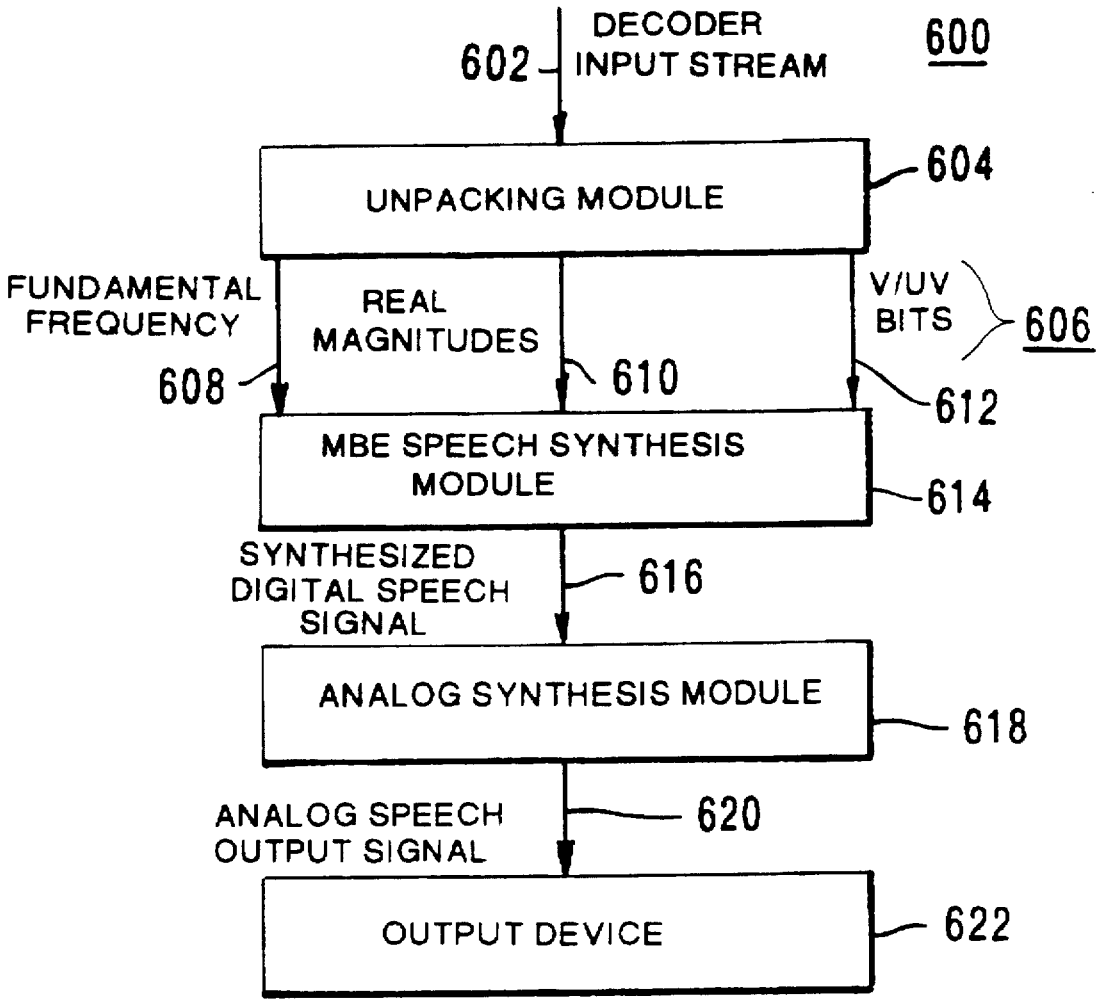
FIG. 6 shows a block diagram of the perceptual speech decoder of the present invention.

An 8-bit code corresponding to zero phase 522 is then sent. This code represents the (mock) phase of the first non-zero segment in the frame, which is unvoiced. The next 10-bits 524 are the quantized fundamental frequency of the second frame 420. For each of the two unvoiced segments 426, a 1-bit segment classifier and an 8-bit coded magnitude 526 are sent to the data stream. For the remaining voiced segment 428, a 1-bit segment classifier, an 8-bit magnitude code, and an 8-bit phase code 528 are sent to the data stream. The third through fifth frames 430 are all silence frames, and a single 8-bit code 530 is used to transmit this information. Frame six 460 is coded 560 similarly to the first two 2. Perceptual Speech Decoding FIG. 6 shows a block diagram of the perceptual speech decoder 600 of the present invention. Output data stream 132—directly, from storage, or through a form of transmission—is used as decoder input stream 602. Decoder 600 decodes this signal and synthesizes it into analog speech output signal 620.

Information unpacking module 604 unpacks decoder input stream 602 so that the synthesizer can identify each segment of each frame of speech. Information packing module 604 extracts a plurality of quantized information, including pitch information, V/UV information, complex magnitude information, and information indicating which frames were declared as silence frames and which segments were zeroed. Module 604 produces unpacked output 606 comprising fundamental frequency 608, real magnitudes 610 (which contains real magnitudes and phases), and V/UV bits 612 for each frame of speech to synthesize.

The procedure for unpacking the information proceeds as follows. The first eight bits are read from the data stream. If they correspond to silence frames, silence can be generated and sent to the speech output and the next eight bits are read from decoder input stream 602. As soon as the first eight bits in a frame do not represent one or more silence frames, then the frame must be segmented. The next 10 bits are read from decoder input stream 602, which contain the quantized fundamental frequency for the present frame as well as the number of segments in the frame. Fundamental frequency 608 is extracted and the number of segments is calculated before continuing to read data from the stream.

In the preferred embodiment, two buffers are used to store the state of unpacking. A first buffer contains the V/UV state of the present harmonic, and a second buffer counts the number of harmonics that are left to calculate for the present frame. One bit is read to obtain V/UV bit 612 for the present harmonic. Eight bits (a magnitude codeword) are read for each expected unvoiced segment (or for an expected voiced segment with a reserved codeword), or sixteen bits (a phase and a magnitude codeword) are read for each expected voiced segment. If the first eight bits in a frame declared voiced correspond to a codeword that was reserved for zeroed-segments, the number of segments represented in this codeword are treated as voiced segments with zero amplitude and phase.

In the preferred embodiment, two ADPCM decoders are used to obtain quantized phase and magnitude values comprising real magnitudes 610. Buffers in these decoders for quantization step size, predictor values, and multiplier values are set to default parameters used to encode the first segment. The default values are known prior to transmission of signal data. Codes will be deciphered and quantization step size will be adjusted by dividing by the multiplier used in encoding. This multiplier can be determined directly from the present codeword. Other values may also be needed to initialize decoder 600, such as the reference level and quantization step size for computing fundamental frequency 608.

Upon completion of the unpacking process in module 604, unpacked output 606 is provided to MBE speech synthesis module 614 for synthesis into synthesized digital speech signal 616. The complex magnitudes of all the voiced frames are calculated with a polar to rectangular calculation on the quantized dam. Then all of the frame information is sent to an MBE speech synthesis algorithm, which may be assembled in the manner suggested by Griffin et al. cited above, or other known ways.

For example, synthesized digital speech signal 616 may be synthesized as follows. First, unpacked output 606 is separated into voiced and unvoiced sections as dictated by V/UV bits 612. Real magnitudes 610 will contain phase and magnitude information for voiced segments, while unvoiced segments will only contain magnitude information. Voiced speech is then synthesized from the voiced envelope segments by summing sinusoids at frequencies of the harmonics of the fundamental frequency, using magnitude and phase dictated by real magnitudes 610. Unvoiced speech is then synthesized from the unvoiced segments of real magnitudes 610. The Short Time Fourier Transform (STFT) of broadband white noise is amplitude scaled (a different amplitude per segment) so as to resemble the spectral shape of the unvoiced portion of each frame of speech. An inverse frequency transform is then applied, each segment is windowed, and the overlap add method is used to assemble the synthetic unvoiced speech. Finally, the voiced and unvoiced speech are added to produce synthesized digital speech signal 616.

Synthesized digital speech signal 616 is provided to analog synthesis module 618 to produce analog speech output signal 620. In the preferred embodiment, the digital signal is sent to a digital-to-analog converter using a 10 kHz sampling rate and then filtered by a 5 kHz low-pass analog anti-image postfilter. The resulting analog speech output signal 620 may be sent to speakers, headphones, tape storage, or some other output device 622 for immediate or delayed listening. Alternatively, decoded digital speech signal 616 may be stored prior to analog synthesis in suitable application contexts.

3. Hardware Configuration of Perceptual Coder

Figure 7:
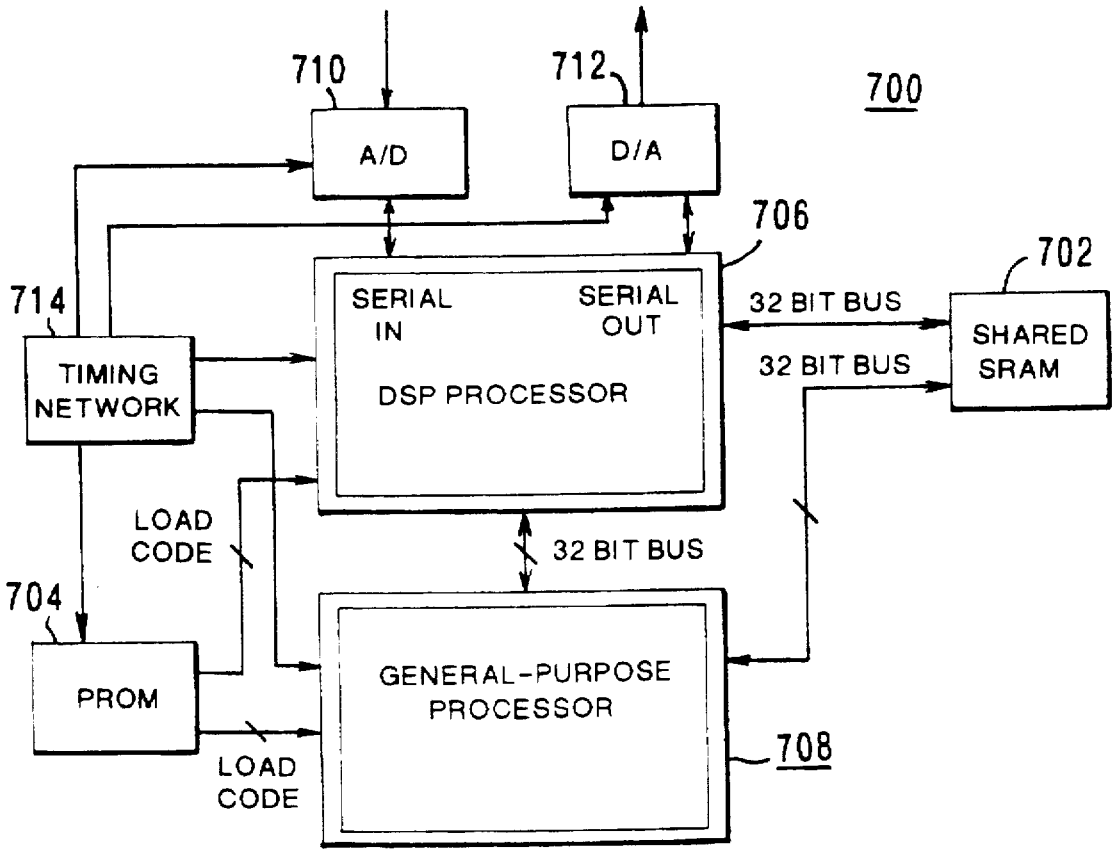
FIG. 7 shows a block diagram of a representative hardware configuration of a real-time perceptual coder.

FIG. 7 shows a block diagram of a representative hardware configuration of a real-time perceptual coder 700. It comprises volatile storage 702, non-volatile storage 704, DSP processor 706, general-purpose processor 708, A/D converter 710, D/A converter 712, and timing network 714.

Perceptual coding and decoding do not require significant storage space. Volatile storage 702, such as dynamic or static RAM, of approximately 50 kilobytes is required for holding temporary data. This requirement is trivial, as most modern processors carry this much storage in on-board cache memory. In addition, non-volatile storage 704, such as ROM, PROM, EPROM, EEPROM, or magnetic or optical disk, is needed to store application software for performing the perceptual coding process shown in FIG. 1, application software for performing the perceptual decoding process shown in FIG. 4, and look-up tables for holding masking data, such as that shown in FIG. 3. The size of this storage space will depend on the particular techniques used in the application software and the approximations used in preparing masking data, but typically will be less than 50 kilobytes.

Perceptual coding requires a high but realizable FLOP rate to run in real-time mode. The coding process shown in FIG. 1 comprises four computational parts, including MBE analysis module 106, auditory analysis module 116, audibility thresholding module 120, and quantization module 124. These modules may be implemented with algorithms requiring $O(n^2)$, $O(n^3)$, $O(1)$, and $O(n)$ operations, respectively, where n is the number of frames used in analysis. In the preferred embodiment, 14 frames (3 frames for backward masking, 10 frames for forward masking, and the present frame) are used. The decoding process shown in FIG. 6 is computationally light and may be implemented with an algorithm requiring $O(n)$ operations. In real-time mode, the coding and decoding algorithms must keep up with the analog sampling rate, which is 10 kHz in the preferred embodiment.

Real-time perceptual coder 700 includes DSP processor 706 for front-end MBE analysis, which is multiplication-addition intensive, and at least one fairly high performance general-purpose processor 708 for the rest of the algorithm, which is decision intensive. The heaviest computing demand is made by the auditory analysis module 116, which requires on the order of 100 MFLOPS. To meet this load, general-purpose processor 708 may be a single high-performance processor, such as the DEC Alpha, or several "regular" processors, such as the Motorola 68030 or Intel 80386. As processor speed and performance increase, most future processors are likely to be sufficient for use as general processor 708.

A/D converter 710 is used to filter, sample, and digitize an analog input signal, and D/A converter 712 is used to synthesize an analog signal from digital information and may optionally filter this signal prior to output. Timing network 714 provides clocking functions to the various integrated circuits comprising real-time perceptual coder 700.

Numerous variations on real-time perceptual coder 700 may be made. For example, a single integrated circuit that incorporates the functionality provided by the plurality of integrated circuits comprising real-time perceptual coder 700 may be designed. For applications with limited processing power, a real-time perceptual coder with increased efficiency may be designed in which approximations are used in the psycho-acoustic look-up tables to calculate masking effects. Alternatively, a system may be designed in which only simultaneous or temporal masking is implemented to reduce computational complexity.

The principles of perceptual coding also apply to other contexts. Elements of real-time perceptual coder 700 may be incorporated into existing vocoders to either lower the bit rate or improve the quality of existing coding techniques. Also, the principles of the present invention may be used to enhance automated word recognition. The auditory model of the present invention is able to perceptually weigh regions in the time-frequency plane of speech. If perceptually trivial information is removed from speech prior to feature extraction, it may be possible to create a better feature set due to the reduction of unnecessary information.

A high-quality speech coder was developed for testing. With this coder, relatively transparent speech coding was obtained at bit rates of less than 20 kbits/sec for 10 kHz sampled (5 kHz bandwidth) speech. This rate of 2 bits/sample is one-quarter that available with standard 8-bit μ-law coding (used in present day telephony), yet yields comparable reproduction quality. Several listening tests were performed using degradation mean opinion score (DMOS) tests. In these tests, listeners found that test utterances had sound quality equal to that of reference utterances and that coding was effectively transparent.

Listening tests were also performed to determine the optimal operating point of the decoder. The operating point of the coder was found to have an optimal auditory threshold level of 6 dB (i.e., segments were zeroed in auditory thresholding analysis if they had a perceptual weight label 118 less than or equal to 6 dB). Decreasing the auditory threshold level to 4 dB still coded the MBE synthesized data transparently, but increased the bit consumption of the coder by approximately two percent. Increasing the auditory threshold to 8 dB decreases the coding requirements by less than two percent, but lost the property of transparent coding of the MBE synthesized speech in 50% of the utterances tested.

In addition, listening tests found that the use of 8 bits for coding phase and magnitude information comprising quantized real magnitudes 126 was optimal. Increasing the bit allotment to either caused an increase in total bit requirements by about 10%, but did not result in a performance gain since transparent coding of the MBE speech was already achieved without the use of additional bits. However, if the eight-bit allocations were decreased, the property of transparent coding of the MBE synthesized speech in all tested utterances was lost.

Perceptual coding according to the present invention may be used in a variety of different applications, including high-quality speech coders, low bit-rate coders, and perceptual-weighting front-ends for beam-steering routines for microphone array systems. Perceptual coding schemes may be used for system applications, including speech compression in multi-media conferencing systems, cockpit-to-tower speech communication, wireless telephone communication, voice messaging systems, digital speech recorders, digital answering machines, and storage of large speech databases. However, the invention is not limited to these applications or to the disclosed embodiment. Those persons of ordinary skill in the art will recognize that modifications to the preferred embodiment may be made, and other applications pursued, without departure from the spirit of the invention as claimed below.

We claim:

1. A method for coding an analog speech signal, said method comprising the steps of:

filtering, sampling, and digitizing said analog speech signal to produce a digital speech signal, said digital speech signal comprising a plurality of frames;

performing frequency analysis on said digital speech signal to produce spectral output data for each of said frames, said spectral output data comprising segments, at least two of said segments being approximately 25 Hz or closer in frequency;

performing auditory analysis on said spectral output data to identify segments of said frames that are inaudible to the human auditory system due to simultaneous or temporal masking effects; and coding said spectral output data into an output data stream in which said inaudible segments are compressed and audible segments are not compressed.

2. A coder for coding a speech signal comprising a masking segment and a masked segment approximately 25 Hz or closer in frequency to said masking segment, said coder comprising:

storage means for storing first application software, second application software, and masking data;

a first processor connected to said storage means for using said first application software to generate spectral data for said speech signal; and a second processor connected to said storage means and said first processor for using said second application software, said masking data, and said spectral data to create a coded representation of said speech signal wherein said masked segment is compressed and said masking segment is not compressed.

3. The method of claim 1, wherein said frequency analysis comprises MBE coding.

4. The coder of claim 2 wherein one integrated circuit includes said first processor and said second processor.

5. The coder of claim 4 wherein said first application software includes MBE coding to generate said spectral data.

* * * * *